United States Patent [19]

Grube et al.

[11] Patent Number: 4,723,885

[45] Date of Patent: Feb. 9, 1988

[54] DEVICE FOR THE REMOVAL OF BOBBINS FROM AN AUTOMATIC SPINNING MACHINE

[75] Inventors: Erwin Grube, Bielefeld; Klaus Biervert, Spenge, both of Fed. Rep. of Germany

[73] Assignee: Dürkoppwerke GmbH, Bielefeld, Fed. Rep. of Germany

[21] Appl. No.: 808,050

[22] Filed: Dec. 12, 1985

[30] Foreign Application Priority Data

Jan. 26, 1985 [DE] Fed. Rep. of Germany ..... 3502611

[51] Int. Cl.[4] ..... A01D 90/00

[52] U.S. Cl. ..... 414/331; 414/277; 414/745; 414/281; 414/276; 414/684; 242/35.5 A; 193/44; 198/459

[58] Field of Search ..... 414/331, 267, 680, 609, 414/273, 274, 275, 276, 911, 277, 280, 281, 745, 748, 684; 198/412, 459, 460; 193/44; 242/35.5 A

[56] References Cited

U.S. PATENT DOCUMENTS

| | | | |
|---|---|---|---|
| 1,515,824 | 11/1924 | Best | 414/745 X |
| 2,156,695 | 5/1939 | Klein | 414/745 |
| 2,189,716 | 2/1940 | Kash | 414/684 |
| 2,576,862 | 11/1951 | Smith et al. | 198/459 X |
| 2,755,950 | 7/1956 | Forshey | 414/276 X |
| 3,398,842 | 8/1968 | Schickle | 414/267 X |
| 3,863,778 | 2/1975 | Martin, Sr. | 414/331 |
| 3,924,762 | 12/1975 | Igel | 414/331 |
| 4,071,150 | 1/1978 | Thompson et al. | 414/276 X |
| 4,331,230 | 5/1982 | Buckley | 414/331 X |
| 4,423,807 | 1/1984 | Muller | 198/459 X |
| 4,555,215 | 11/1985 | Raasch et al. | 414/331 X |

FOREIGN PATENT DOCUMENTS

| | | | |
|---|---|---|---|
| 689912 | 10/1979 | U.S.S.R. | 414/331 |

*Primary Examiner*—Frank E. Werner

*Attorney, Agent, or Firm*—Oblon, Fisher, Spivak, McClelland & Maier

[57] ABSTRACT

A device for the removal of bobbins from an automatic rotor spinning machine having a conveyor belt placed on the automatic spinning machine for collecting and delivering completed bobbins comprises a transfer device with a frame, a receiving conveyor belt swiveling on the frame in a vertical direction for receiving bobbins from the automatic spinning machine, a roller conveyor section extending the receiving conveyor belt and which can be swiveled between a position inclined in the direction of feed and a horizontal position, a receiving chute placed parallel to the roller conveyor section, a pusher for transfer of bobbins from the roller conveyor section to the receiving chute, a lifting device for vertically moving the receiving chute between a position adjacent to the roller conveyor section and a number of additional positions, and a tilting device for tilting the receiving chute around its longitudinal axis between a horizontal receiving position and a position essentially at a 90° angle to it for ejecting the bobbins into a magazine cart.

9 Claims, 3 Drawing Figures

DEVICE FOR THE REMOVAL OF BOBBINS FROM AN AUTOMATIC SPINNING MACHINE

BACKGROUND OF THE INVENTION

1. Field of the Invention

The invention relates to a device for the removal of bobbins from an automatic rotor spinning machine or the like, with a conveyor belt placed on the automatic spinning machine to collect and deliver completed bobbins and a magazine cart for receiving the bobbins.

2. Description of the Prior Art

In the case of certain so-called automatic rotor spinning machines the completed cross-wound bobbins are automatically delivered at irregular intervals onto two conveyor belts which, according to the number of bobbin positions and thus the length of the installation, extend along the top side of the installation. At a longitudinal end, a 180° turnaround is provided so that all bobbins are collected on one of the two parallel conveyor belts and are delivered by the latter to its other end.

The transfer of the bobbins from this delivery end of the conveyor belt to a so-called magazine cart, which is a freely movable cart with a receiving magazine for receiving a sizable number of bobbins, is typically done manually. Since the bobbins have a not inconsiderable weight of, e.g., 4.5 kg, are removed from an elevated position on the top side of the automatic spinning machine and must sometimes be placed into shelves that are located deep in the magazine cart, this work is strenuous and especially time-consuming. During doffing, the bobbins of the automatic spinning machine at first can continue to run; however, placing them on the mentioned conveyor belts is not possible since the latter at this time are needed for removal of the already deposited bobbins and there is no guarantee that the position lying over a bobbin position will be free at the appropriate time. Threfore the bobbins must be gradually switched off until the spinning process comes to a complete halt. In view of the otherwise high efficiency of such automatic spinning machines, this leads to considerable production losses.

SUMMARY OF THE INVENTION

Therefore the object of the invention is to provide a device that makes possible the automatic and quick doffing of a bobbin from an automatic spinning machine.

This object is attained according to the invention with a device of the typed described above including a transfer device with a frame, a receiving conveyor belt vertically swiveling on the frame, a roller conveyor section extending the receiving conveyor belt, which roller conveyor section can swivel between a position inclined in the direction of feed and a horizontal position, a receiving chute placed parallel to the roller conveyor section, a pusher to transfer bobbins from the roller conveyor section to the receiving chute, a lifting device for vertically moving the receiving chute between a position adjacent to the roller conveyor section and a number of other positions, and a tilting device for tilting the receiving chute around its longitudinal axis between a horizontal receiving position and a position essentially at a 90° angle to it for ejecting bobbins into the magazine cart.

The device according to the invention performs a series of different functions in the transfer of the bobbins from the automatic spinning machine into the magazine cart. To start with, the receiving conveyor belt can swivel in a vertical direction which makes possible a direct coupling to the delivery end of said conveyor belt on the top side of the automatic spinning machine, which at this delivery end is inclined downward, in most cases slightly, e.g., at an 11° angle. The receiving conveyor belt can, e.g., be designed with an essentially identical angular orientation to with that of the receiving conveyor, so that the bobbins can be preliminarily transferred by the receiving conveyor belt from the height of the top side of the automatic spinning machine to a lower and better reachable position.

The receiving conveyor belt transfers, while controlled by a photoelectric barrier or the like, a preset number of bobbins to the roller conveyor section mounted in the interior of the frame of the transfer device. This roller conveyor section when receiving the bobbins at first has the inclination of the receiving conveyor belt. As soon as a preset number of bobbins has been placed in the roller conveyor section, the latter is swiveled to a horizontal position, so that the bobbins are now arranged in a horizontal row. A pusher transfers the bobbins from the roller conveyor section to the receiving chute lying parallel to the roller conveyor section.

The receiving chute is connected with a lifting device and can be moved in vertical direction from its position next to the roller conveyor section to various heights according to the different receiving levels of the magazine cart. As soon as one of these heights is reached, the receiving chute is tilted around its longitudinal axis in the direction of the magazine cart, so that the bobbins roll into the adjoining shelf of the magazine cart.

Preferably either the roller conveyor section or the receiving chute is provided with a separating device which permits enlarging the spacing between the arrayed bobbins according to the spacing of the receiving positions of the magazine cart.

Once doffing from the automatic spinning machine has been completed, the receiving conveyor belt can be swiveled to a vertically raised position. In this position a doffing cart, which is movable along the bobbin positions, can pass the doffing position.

Even though the possibility exists of combining into one unit the functions of the roller conveyor section and of the receiving chute, namely the receiving of the bobbins, the swiveling into the horizontal arrangement, the raising to the height of the desired magazine shelf and the separating, the separate use of the roller conveyor section and the receiving chute makes possible more rapid operation since the roller conveyor section can receive additional bobbins while the receiving chute is moved up and down and delivers the bobbins to the appropriate magazine shelf.

DETAILED DESCRIPTION OF THE PREFERRED EMBODIMENTS

Figure 1:
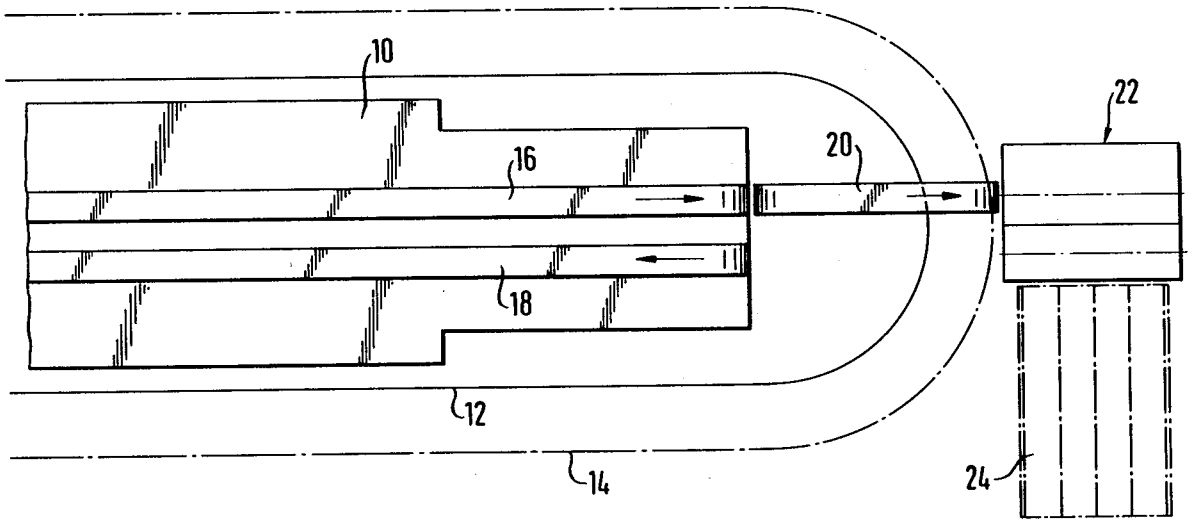
FIG. 1 is a schematic plan view of an end section of an automatic spinning machine, a doffing device according to the invention and a magazine cart.

FIG. 1 schematically shows an end section of automatic spinning machine 10 which, e.g., has two opposite rows of bobbin positions, not shown. A continuous line 12 surrounding the automatic spinning machine in FIG. 1 illustrates the path of movement of a doffing cart whose outer contour is indicated by dot-dash line 14.

The completed cross-wind bobbins are delivered in a manner not shown onto two conveyor belts 16, 18, which run parallel to one another on the top side of the automatic spinning machine. As indicated by arrows, conveyor belt 18 runs to the left in FIG. 1 to a turnaround, not shown, so that all bobbins delivered on conveyor belt 18 are delivered by the turnaround to the other conveyor belt 16 whose direction of feed is, as indicated by the arrow, opposite that of conveyor 18 and serves for delivery of the bobbins.

From this conveyor belt 16, the bobbins are transferred to receiving conveyor belt 20, which transfers the bobbins to a transfer device 22 from which the bobbins are delivered into a magazine cart 24. These last-named parts are discussed in detail below.

Figure 2:
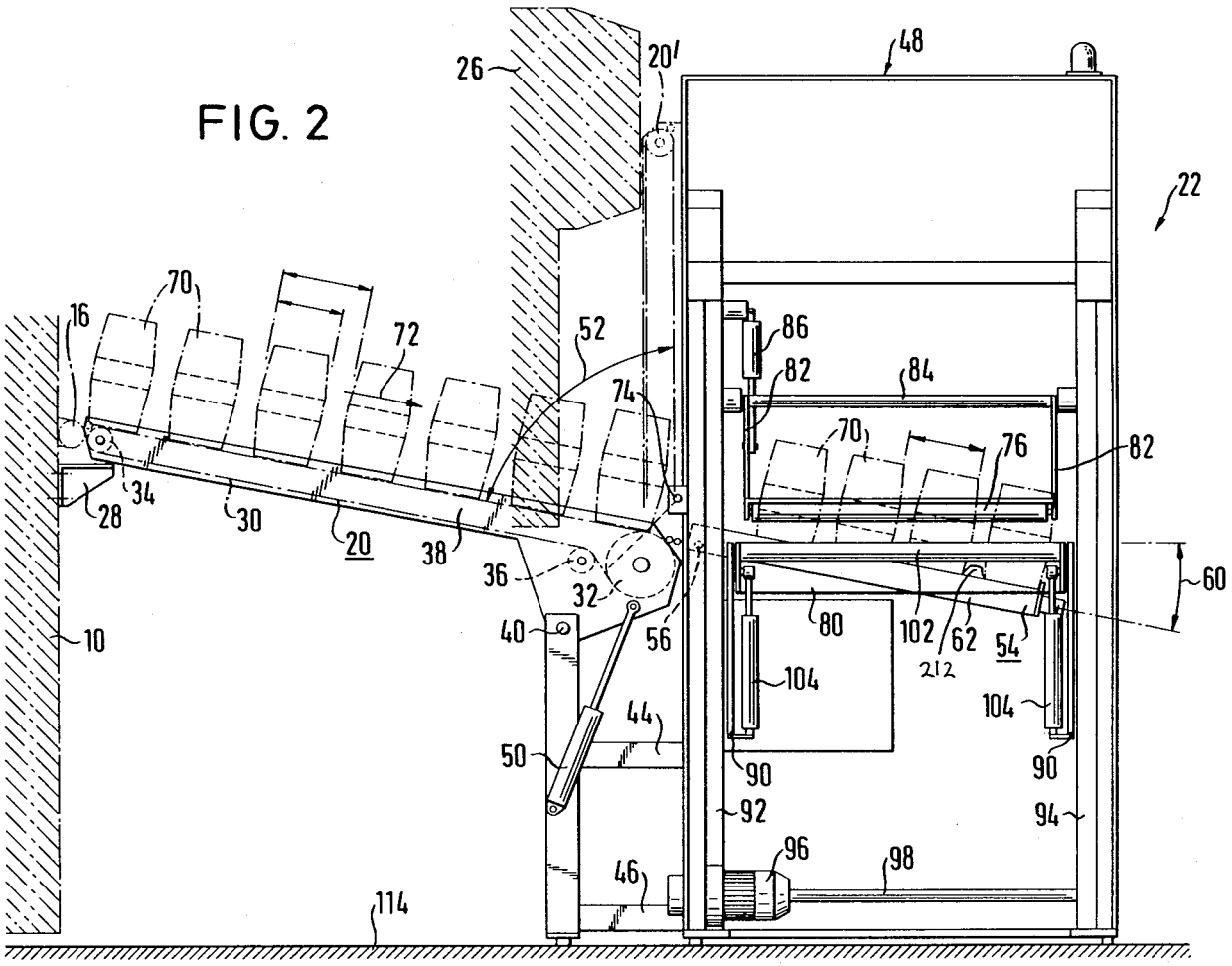
FIG. 2 is a front projection of the doffing device according to the invention.

In FIG. 2, as boundary conditions for the transfer device according to the invention, the contour of automatic spinning machine 10 and that of the path of movement of the doffing cart are represented as hatched areas which, in the case of the doffing cart, is indicated by reference number 26. The delivery end of conveyor belt 16 is seen projecting slightly beyond automatic spinning machine 10. This delivery end is slightly inclined downward, e.g., at an 11° angle. A support 28 is fastened to automatic spinning machine 10 on which the free end of receiving conveyor belt 20 is supported. This receiving conveyor belt is designed as a belt conveyor with a belt 30, a drive roller 32, a guide roller 34 and a tension roller 36. These rollers are mounted between two frame elements 38, which at their end lying on the right side in FIG. 2 have a lug directed downward which can swivel on a vertical support 42 about an axle pin 40. This support 42 is connected by cross struts 44 and 46 with a frame of the transfer device according to the invention, this frame generally designated as 48.

Receiving conveyor belt 20 and its support elements are so designed that belt 30 has essentially the same downward inclination as the delivery end of conveyor belt 16. A pneumatic cylinder 50, which is pivotally fastened by one end to vertical support 42 and by the other, piston-rod side, end to one of the frame elements 38 of receiving conveyor belt 20, makes possible the vertical swiveling of the conveyor belt according to double arrow 52 about an axis fixed to the frame 48 and into an upright position 20′ shown by a dot-dash line. It is evident that the doffing cart then can pass under the receiving conveyor 20.

The frame 48 of the transfer device has an essentially rectangular design, four vertical supports at the four corners and a series of cross struts, as well as a partially closed covering made of sheet metal, metal mesh, or the like; however, these parts are not to be considered in detail since they are of no importance in the functioning of the device.

A roller conveyor section 54, grooved in cross section, is mounted in the frame. The roller conveyor section is placed directly adjoining the delivery end of the receiving conveyor belt 20 and swivel-mounted around axis 56. The swiveling is produced with the aid of pneumatic cylinder 58 (FIG. 3) according to double arrow 60 between an essentially horizontal position and the downward inclined position shown in FIG. 2, in which roller conveyor section 54 continues receiving conveyor belt 20 with an essentially identical inclination. Roller conveyor section 54 has a longitudinally directed, troughlike support profile 62 defined by a number of slanted and grooved rollers 64 and 66 on its rims, and optionally additional rollers 68 on its bottom.

FIG. 2 illustrates a number of bobbins 70 represented by dot-dash lines which are advanced in the direction of arrow 72, with their axis of rotation lying in the direction of feed and positioned on top of the receiving conveyor belt. A photoelectric barrier 74 controls the delivery of bobbins 70 onto roller conveyor section 54 and limits the delivery for each conveying cycle to, i.e., four bobbins, as shown in FIG. 2. By use of rollers 64, 66 and 68 it is assured that all bobbins are moved to a lower stop, not shown, at the right end of FIG. 2, or directly bump against one another. Thus the spacing of the bobbins, which in most cases is not uniform on receiving conveyor belt 20, is made uniform. After receiving the bobbins, roller conveyor section 54 is swiveled around axis 56 with the aid of pneumatic cylinder 58 into an essentially horizontal position.

Figure 3:
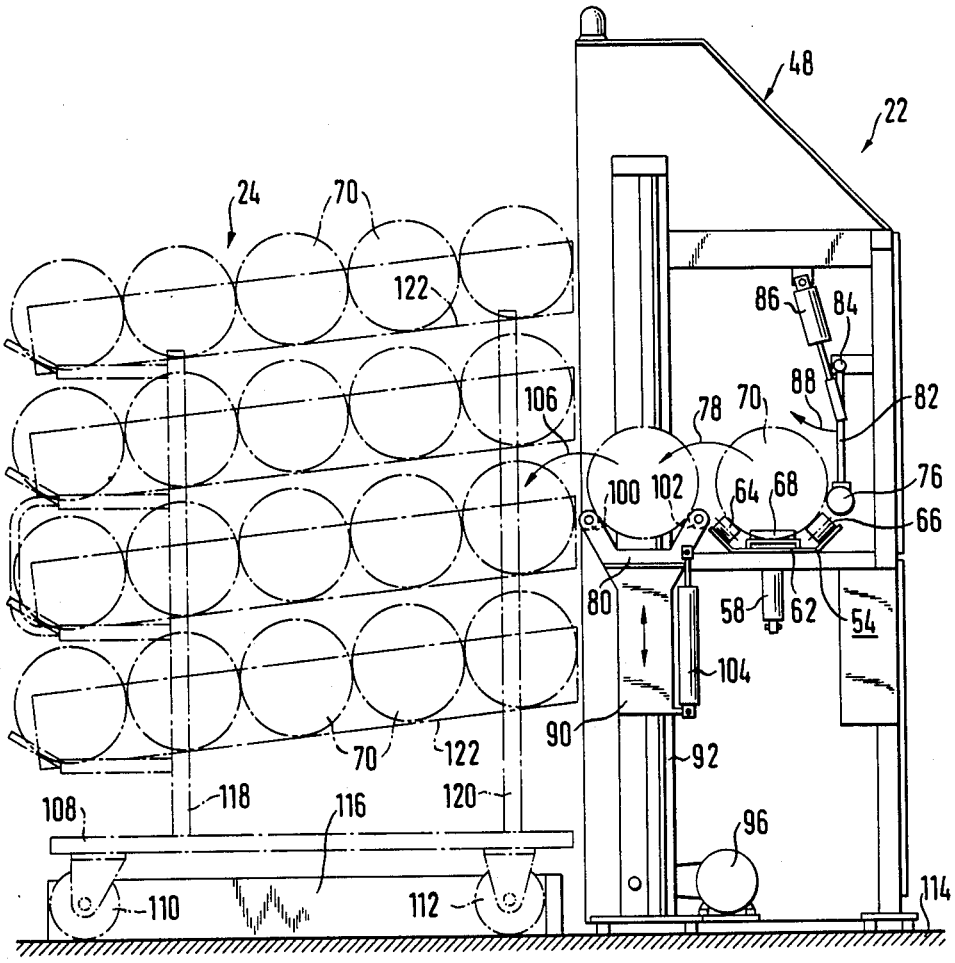
FIG. 3 is a view from the right side in FIG. 2.

In this horizontal position the four bobbins 70 are transferred, as seen according to arrow 78 in FIG. 3, with the aid of pusher 76 into a receiving chute 80 lying parallel next to roller conveyor section 54. Pusher 76 can swivel by arms 82 about a stationary axis 84 and can be moved with the aid of pneumatic cylinder 86 in direction of arrow 88, as can be seen from FIG. 3. Of course, a pusher with a linear movement can also be used.

Since the axes of bobbins 70 are located in the longitudinal direction of roller conveyor section 54, the bobbins can be rolled into receiving chute 80 without any difficulty.

Receiving chute 80 is supported on both its ends by carriages 90 which can move in vertical guides 92 and 94 with the aid of a spindle, not shown, a drive motor 96 and a drive shaft 98.

Thus receiving chute 80 can be brought not only into the position shown in FIG. 3 directly adjacent to roller conveyor section 54 but also into additional holding positions at different heights according to the heights of various shelves of a magazine cart, which is to be described in detail below. Receiving chute 80 has on its two side rims rollers 100 and 102 which facilitate receiving and delivery of the bobbins. Receiving chute 80, moreover, can swivel about the axis of rollers 100 mounted on carriage 99. The swiveling takes place with aid of pneumatic cylinders 104, one end of which is fastened to the carriage 99 and the other to receiving chute 80, as can be seen from FIG. 3. By this swivel movement, bobbins 70 are transferred according to arrow 106 into magazine cart 24 (FIG. 3).

Magazine cart 24 in the embodiment shown has an undercarriage 108 with steerable and fixed idler wheels 110 and 112. A curb is provided on the floor in front of frame 48, into which curb the magazine carts 24 can be pushed and which determines the position of the magazine carts in front of the transfer device. Vertical supports 118 and 120 are fastened to undercarriage 108. On these supports in the embodiment, chutes 122 are suspended in four superposed planes represented by dot-dash lines, which are inclined downward from right to left FIG. 3, so that bobbins 70 roll to the left end of each chute 122 unaided. The number of chutes 122 adjacent to one another on each plane corresponds to the number of bobbins 70 received from roller conveyor section 54 and simultaneously passed on. Thus the magazine cart 24 shown has in every plane four adjacent chutes 122.

As shown, carriages 90 can be so operated that the chutes can be filled with bobbins successively in all planes.

It has already been pointed out that bobbins 70 when arriving in roller conveyor section 54 bump against one another and consequently are subsequently directly adjacent to one another because of the inclination of this section. When introducing the bobbins into chutes 122 of magazine cart 24, a certain spacing between the individual bobbins is, however, desired, which takes into account the partitions between the individual chutes. For this reason, a separating machanism is preferably provided, which achieves a somewhat equal distance between bobbins 70 either on roller conveyor section 54 or on receiving chute 80.

A design for the separating mechanism possibly consists in providing retractable or liftable spacing stops 212 at the bottom of roller conveyor section 54, which spread the bobbins. Another possibility consists in forming receiving chutes 80 from individual elements that can be shifted to a limited extent in the axial direction of the bobbins on the receiving chute, which, e.g., can be guided on rods placed in the axes of rollers 100 and 102, not shown.

For pushing together and spreading the spacing stops or segments, they are preferably linked with a degree of play, so that, on the one hand, they can be completely pushed together but, on the other hand, form a chain that can be spread, a chain in which, through an external drive link, all other links are successively and gradually pulled along. A pneumatic cylinder is suitable as a drive source.

Transfer device 22 according to the invention can have support wheels and can be designed to be mobile, so that it can be used for doffing from several automatic spinning machines.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for the removal of bobbins from a top conveyor belt of an automatic rotor spinning device to a magazine cart, said device comprising:

a transfer frame;

a receiving conveyor belt having one end mounted on said transfer frame for pivoting about a first horizontal axis to a position for receiving bobbins from said spinning device conveyor belt at the other end thereof;

a roller conveyor section having one end mounted on said frame for pivoting about a second horizontal axis between an inclined position wherein said roller conveyor section forms an extension of said receiving conveyor belt and a horizontal position wherein said roller conveyor section is horizontal;

receiving chute means positionable adjacent said roller conveyor section in said horizontal position;

pusher means movable for transferring bobbins from said roller conveyor section in said horizontal position to said receiving chute means;

means for mounting and vertically moving said receiving chute means on said frame means; and means for tilting said receiving chute means to a bobbin ejection position, said tilting means being located on said vertically moving means, whereby the bobbins may be transferred to the magazine cart.

2. The device of claim 1 including photoelectric bobbin detecting means at a junction of said receiving conveyor belt and said roller conveyor section, and means responsive to said bobbin detecting means for controlling a movement of said belt conveyor.

3. The device of claim 1 including roller conveyor section moving means connected between said roller conveyor section and said transfer frame.

4. The device of claim 1 wherein said receiving chute means comprise:

a receiving chute; and first and second sets of rollers mounted on said receiving chute about first and second parallel and horizontal axes which are spaced in a direction of movement of said pusher means.

5. The device of claim 4 wherein said means for tilting comprise means for pivoting one of said sets of rollers nearest said roller conveyor section about said axis of the other of said sets of rollers.

6. The device of claim 5 wherein said means for pivoting are mounted to said carriage.

7. The device of claim 4 wherein said means for vertically moving comprise:

a vertically movable carriage;

vertical guides on said frame; and means for moving said carriage along said vertical guides.

8. The device of claim 4 including means for providing a predetermined constant positive spacing between said bobbins being tilted to said bobbin ejecting position.

9. The device of claim 1 wherein said transfer frame is mounted on wheels for movement in a horizontal direction.

* * * * *